United States Patent [19]

Cervera

[11] 3,973,422

[45] Aug. 10, 1976

[54] DEFROSTER KEY CASE

[75] Inventor: Frank Cervera, Yonkers, N.Y.

[73] Assignee: Lawrence Peska Associates, New York, N.Y. ; a part interest

[22] Filed: Feb. 11, 1975

[21] Appl. No.: 549,069

[52] U.S. Cl. ..... 70/431; 70/456 R; 219/201

[51] Int. Cl.[2] ..... A45C 11/32; H05B 3/06

[58] Field of Search ..... 70/431, 456, DIG. 46; 219/201, 202, 209

[56] References Cited

UNITED STATES PATENTS

| | | | |
|---|---|---|---|
| 1,909,941 | 5/1933 | Finch | 70/456 R X |
| 2,965,741 | 12/1960 | Blazina | 70/431 X |

FOREIGN PATENTS OR APPLICATIONS

| | | | |
|---|---|---|---|
| 1,430,621 | 12/1968 | Germany | 219/202 |
| 424,172 | 8/1947 | Italy | 70/456 R |

*Primary Examiner*—Paul R. Gilliam
*Assistant Examiner*—Carl F. Pietruszka

[57] ABSTRACT

A key case which includes a battery and a coil disposed in coaxial relationship with respect to a swivel pin for carrying keys. A switch selectively connects the battery and the coil for heating of the keys to assist in insertion thereof into locks which may be frozen.

1 Claim, 3 Drawing Figures

DEFROSTER KEY CASE

BACKGROUND OF THE INVENTION

The invention relates to key cases and particularly to key cases having the capability of heating the key disposed therein. The prior art includes apparatus such as that shown in Bucky, U.S. Pat. No. 3,703,634 issued Nov. 21, 1972. The Bucky patent recognizes the problem of heating keys and particularly the problem of providing a heater when it is needed. Very often locks will become frozen when the owner is away from his home or in a manner which prevents him from entering the interior of the car. Accordingly it is clearly desirable to provide means for heating the key which is readily available. The Bucky apparatus unfortunately does not meet this requirement in that it relates merely to a flashlight having an integral key heater function. It assumes that the user will be carrying a special flashlight when a frozen lock on their car or building or other place is encountered.

Accordingly, it is the primary object of the invention to provide apparatus which is readily available when the need arises for heating a key.

It is still another object of the invention to provide apparatus which is simple and inexpensive to manufacture.

SUMMARY OF THE INVENTION

It has now been found that these and other objects of the invention may be satisfied by apparatus which comprises a key case having and disposed therein a swivel pin for engaging at least one key and a coil disposed in concentric relationship to the pin. A battery is provided together with switch means for selectively connecting the coil to the battery.

In some embodiments of the invention the case for the keys will be of a hard plastic material and will be provided with a small flap having a snap thereon for holding the keys there within.

BRIEF DESCRIPTION OF THE DRAWING

The specification concludes with claims particularly pointing out and distinctly claiming the subject matter which I regard as my invention. It is believed the invention will be better understood from the following description taken in conjunction with the accompanying drawing which:

DESCRIPTION OF A PREFERRED EMBODIMENT

Figure 1:
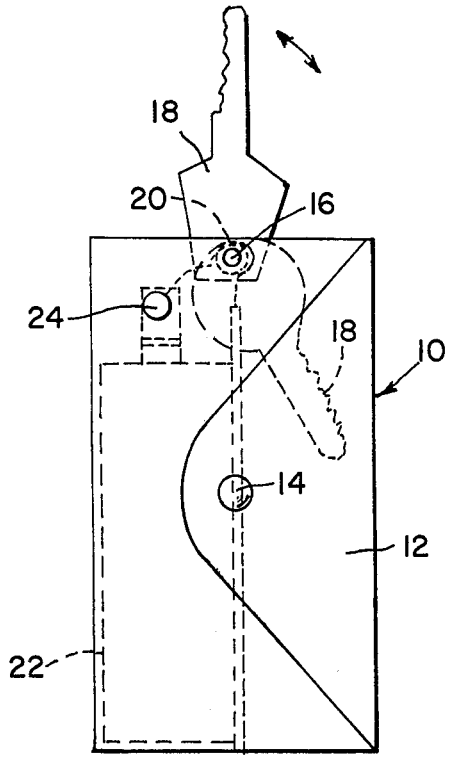
FIG. 1 is a side elevational view in accordance with one embodiment of the invention.
Figure 2:
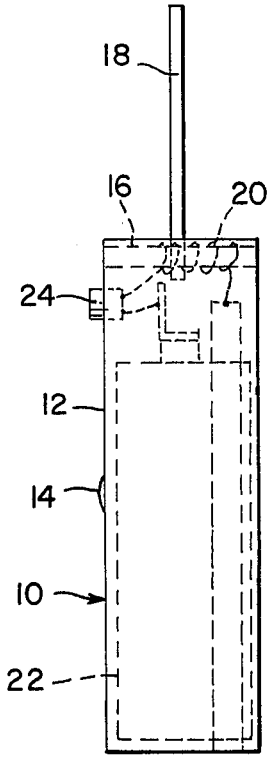
FIG. 2 is a front elevational view of the apparatus shown in FIG. 2.
Figure 3:
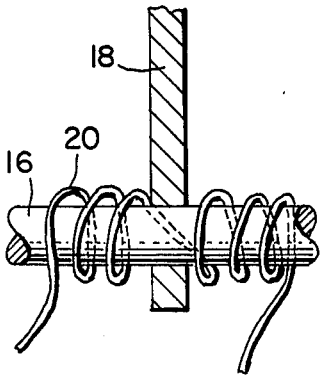
FIG. 3 is a broken away view of a partial section of the apparatus shown in FIGS. 1 and 2.

Referring now to FIGS. 1, 2, and 3 there is shown a key case 10 in accordance with one aspect of the invention. The case is normally of hard plastic material and is envelope shaped including a flap having a snap 14 as a closure. A swivel pin 16 is mounted extending between a pair of opposed sidewalls of case 10. The pin 16 is adapted to rotatably carry keys 18. The pin 16 is of the conventional type constructed of thermally conductive material such as metal and a heater coil 20 of resistance wire is loosely wrapped about pin 16 in heat transfer relationship therewith.

The coil 20 is selectively connected to a battery 22 held within case 10, by means of a push button switch 24 carried by the case. Having thus described my invention it is intended that it be limited only by the appended claims.

Having herein described the invention, what is claimed as new is:

1. In a key case having a pair of opposed sidewalls and a pin extending between said sidewalls, said pin being of a diameter for rotatably and slideably carrying keys thereon, the improvement comprising: a heater coil wrapped about said pin in heat transfer relationship therewith; a battery within said case; and switch means carried by said case in a series circuit with said battery and said heater coil.

* * * * *